US007168578B2

(12) United States Patent
Mersch et al.

(10) Patent No.: US 7,168,578 B2
(45) Date of Patent: Jan. 30, 2007

(54) DISHWASHER RACK ASSEMBLIES

(75) Inventors: Matthew David Mersch, Louisville, KY (US); Joseph Duane Tobbe, Taylorsville, KY (US); Michael John Utschig, Wauwatosa, WI (US); Kevin Farrelly Nolan, Shepherdsville, KY (US); Gregory Owen Miller, Louisville, KY (US)

(73) Assignee: General Electric Company, Schenectady, NY (US)

( * ) Notice: Subject to any disclaimer, the term of this patent is extended or adjusted under 35 U.S.C. 154(b) by 194 days.

(21) Appl. No.: 10/740,166

(22) Filed: Dec. 18, 2003

(65) Prior Publication Data

US 2005/0133469 A1 Jun. 23, 2005

(51) Int. Cl.
*A47L 15/50* (2006.01)
*A47G 19/08* (2006.01)

(52) U.S. Cl. ..... 211/41.8; 211/41.9; 134/56 D; 312/334.4

(58) Field of Classification Search ..... 211/41.8, 211/41.9, 41.1, 85.4; 312/334.4, 306, 312, 312/321, 330.1, 334.1, 334.7, 334.8; 134/56 D
See application file for complete search history.

(56) References Cited

U.S. PATENT DOCUMENTS 3,726,580 A 4/1973 Guth
3,726,581 A 4/1973 Doepke
3,736,037 A 5/1973 Doepke
3,761,153 A 9/1973 Guth
3,768,883 A 10/1973 Kauffman
3,809,450 A 5/1974 Guth
3,809,451 A 5/1974 Pitstick
3,822,085 A 7/1974 Clark
3,914,957 A 10/1975 Jacobs
5,115,822 A 5/1992 Nichols
5,303,997 A 4/1994 Kropf
5,315,845 A 5/1994 Lee
5,474,378 A 12/1995 Smith et al.
5,490,547 A 2/1996 Abadi et al.
5,542,264 A 8/1996 Hortin et al.
5,657,878 A 8/1997 Austin
5,860,716 A * 1/1999 Good et al. ..... 312/311
2005/0001524 A1* 1/2005 Deiss et al. ..... 312/334.4

FOREIGN PATENT DOCUMENTS

CH 690488 * 9/2000

* cited by examiner

*Primary Examiner*—Richard E. Chilcot, Jr.
*Assistant Examiner*—Jared Newton
(74) *Attorney, Agent, or Firm*—Armstrong Teasdale LLP

(57) ABSTRACT

An adjustable rack assembly configured to couple to a sidewall of a dishwasher rack is provided. The sidewall having at least one horizontal wire member and at least one vertical wire member. The adjustable rack assembly includes a bracket on one side of the sidewall, the bracket supporting the at least one horizontal wire member in a first rack position and a support plate on another side of the sidewall, the support plate coupled to the bracket, the support plate having at least one arm with a catch member on a distal end thereof for receiving the at least one horizontal wire member in a second rack position.

21 Claims, 4 Drawing Sheets

DISHWASHER RACK ASSEMBLIES

BACKGROUND OF THE INVENTION

This invention relates generally to dishwashers, and more particularly, to dishware racks disposed within dishwashers.

At least some known dishwashers include a cabinet, a tub within the cabinet that defines an open sided wash chamber, and a door assembly that seals the open side of the wash chamber when the dishwasher is in use. Soiled dishes, glasses, utensils, food and beverage containers, etc. are loaded into the dishwasher tub through the open side of the wash chamber when the door is open, and after the door is closed, a dishwasher cycle may be executed to clean the items placed therein. The wash chamber includes a sump portion where washing fluid is pumped from a fluid circulation assembly through spray arm conduits to wash items loaded onto dishwasher racks in the wash chamber, and also where wash fluid is collected after being circulated throughout the wash chamber. The door assembly is attached to the dishwasher at a bottom end of the door and pivots about a hinge between fully open and fully closed positions.

Conventional dishwashing machines include upper and lower dishware racks mounted in the washing chamber. Each rack is typically supported on side walls of the dishwasher and includes rollers for sliding movement between an extended position wherein the rack is substantially outside of the washing chamber and a retracted position wherein the rack is substantially inside the washing chamber. As dishware items are loaded and unloaded, the racks are moved to their extended positions for substantially unobstructed loading of items. The racks are lattice structures adapted for holding dishes, plates, cups, pots, pans and other dishware, cookware, and food storage containers while permitting water spray action for cleaning items in the racks.

However, the washing chamber has limited available vertical space. Any space allocated to the upper rack is at the expense of clearance in the lower rack and vice versa. Typically, an appliance manufacturer decides how to allocate the available space to the lower rack and the upper rack.

BRIEF DESCRIPTION OF THE INVENTION

In one aspect, an adjustable rack assembly configured to couple to a sidewall of a dishwasher rack is provided. The sidewall having at least one horizontal wire member and at least one vertical wire member. The adjustable rack assembly includes a bracket on one side of the sidewall, the bracket supporting the at least one horizontal wire member in a first rack position and a support plate on another side of the sidewall, the support plate coupled to the bracket, the support plate having at least one arm with a catch member on a distal end thereof for receiving the at least one horizontal wire member in a second rack position.

In another aspect, a dishwasher rack is provided. The dishwasher rack includes a plurality of horizontal and vertical wire members forming a bottom surface and lateral extending sidewalls, a bracket having an inner surface and an outer surface, the bracket positioned on one side of the sidewall, the inner surface having grooves, the bracket supporting at least one horizontal member in a first position. The dishwasher rack further includes a support plate having an inner and outer surface, the support plate positioned on an opposite side of the sidewall from the bracket, the inner surface having grooves, the support plate coupled to the bracket such that the grooves of the bracket and the support plate form channels for slidably receiving the vertical wire members, the support plate having at least one arm with a catch member on a distal end thereof for receiving and supporting the at least one horizontal wire member in a second rack position.

In a further aspect, a dishwasher is provided. The dishwasher includes a wash chamber defined by a bottom, oppositely disposed sidewalls, a back wall, and a front access opening, and a rack disposed within the wash chamber, the rack having a plurality of vertical and horizontal wire members forming a bottom surface and lateral extending sidewalls. The rack including a bracket on one side of the sidewall, the bracket supporting the at least one horizontal wire member in a first rack position and a support plate on another side of the sidewall, the support plate coupled to the bracket, the support plate having at least one arm with a catch member on a distal end thereof for receiving the at least one horizontal wire member in a second rack position.

DETAILED DESCRIPTION OF THE INVENTION

Figure 1:
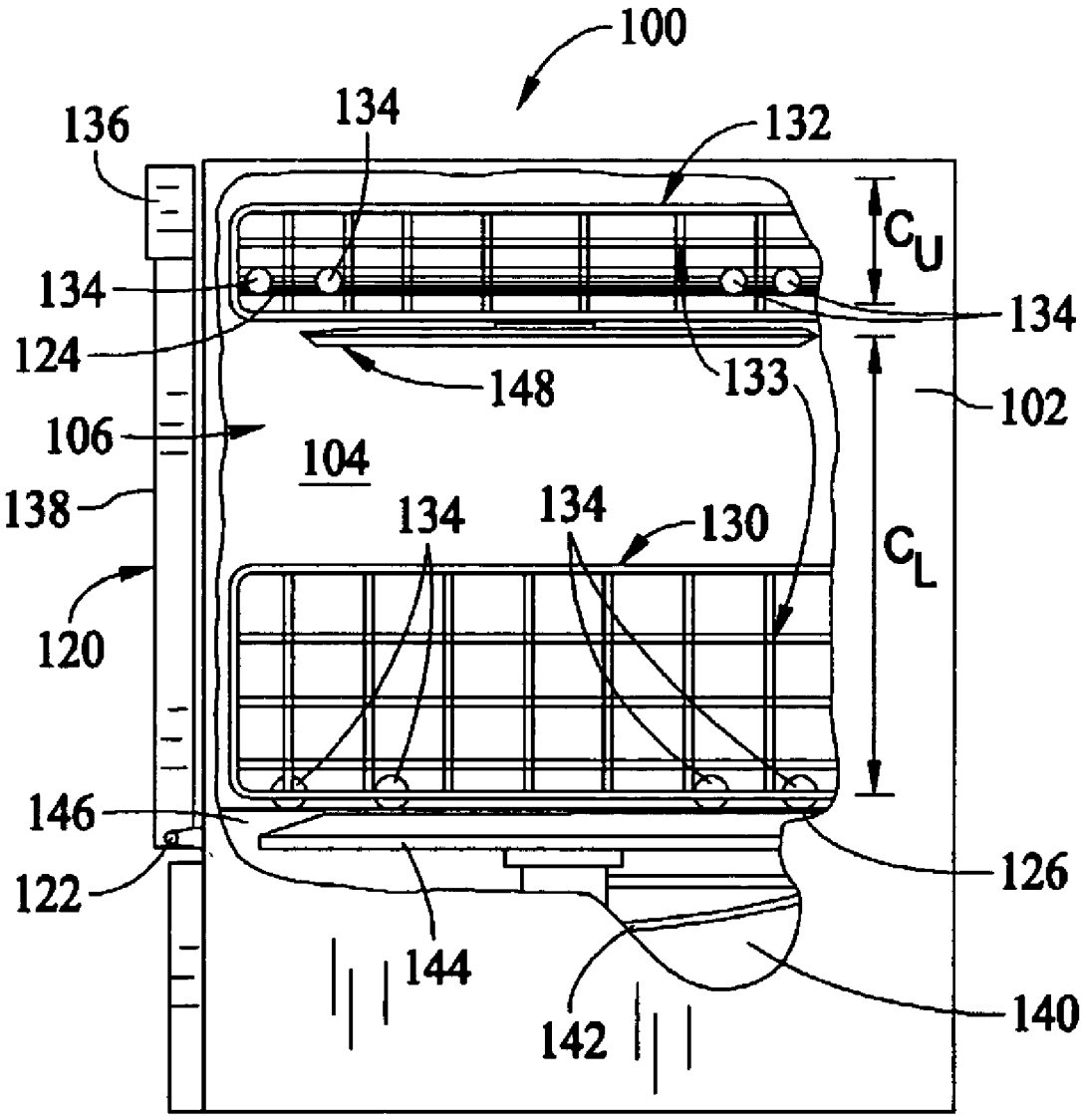
FIG. 1 is a side elevational view of an exemplary dishwasher system.

FIG. 1 is a side elevational view of an exemplary dishwasher 100. Dishwasher 100 includes a cabinet 102 having a tub 104 therein and forming a wash chamber 106. Tub 104 includes a front opening (not shown in FIG. 1) and a door assembly 120 hinged at its bottom 122 for movement about a horizontal axis between a normally closed vertical position (shown in FIG. 1) wherein wash chamber 106 is sealed shut for washing operation, and a horizontal open position (shown in FIG. 2) for loading and unloading of cookware from wash chamber 106. Upper and lower guide rails 124, 126 are mounted on side walls of tub 104 and accommodate a lower cookware rack 130 and an upper cookware rack 132 respectively. Each rack 130, 132 has at least one lateral side 133 that is adapted for horizontal movement on rollers 134 between an extended loading position (not shown) in which the rack is substantially positioned outside wash chamber 106, and a retracted position (shown in FIG. 1) in which the rack is located inside wash chamber 106.

A control panel (not shown) is integrated into an escutcheon 136 that is mounted to door assembly 120, or in further and/or alternative embodiments control selectors, (e.g., buttons, switches or knobs) or control displays, etc. may be mounted at a convenient location on an outer face 138 of door assembly 120. The control panel and associated selectors and displays are coupled to control circuitry (not shown) and control mechanisms (not shown) for operating a fluid circulation assembly (not shown) that circulates water and wash fluid in dishwasher tub 104. The fluid circulation assembly is located in a machinery compartment 140 located below a bottom sump portion 142 of tub 104.

A lower spray-arm-assembly 144 is rotatably mounted within a lower region 146 of wash chamber 106 and above tub sump portion 142 so as to rotate in relatively close proximity to lower rack 130. A mid-level spray-arm assembly 148 is located in an upper region of wash chamber 106 and is located in close proximity to upper rack 132 and at a sufficient height above lower rack 130 to accommodate a largest cookware item that is expected to be placed in lower rack 130 and washed in dishwasher 100.

Lower and mid-level spray-arm assemblies 144, 148 and the upper spray arm assembly are fed by the fluid circulation assembly, and each spray-arm assembly includes an arrangement of discharge ports or orifices for directing washing liquid onto dishes located in upper and lower racks 132, 130, respectively. The arrangement of the discharge ports in at least lower spray-arm assembly 144 provides a rotational force by virtue of washing fluid flowing through the discharge ports. The resultant rotation of lower spray-arm assembly 144 provides coverage of cookware with a washing spray. In various alternative embodiments, mid-level spray arm 148 and/or the upper spray arm are also rotatably mounted and configured to generate a swirling spray pattern above and below upper rack 132 when the fluid circulation assembly is activated and door assembly 120 is properly closed to seal wash chamber 106 for operation.

Figure 2:
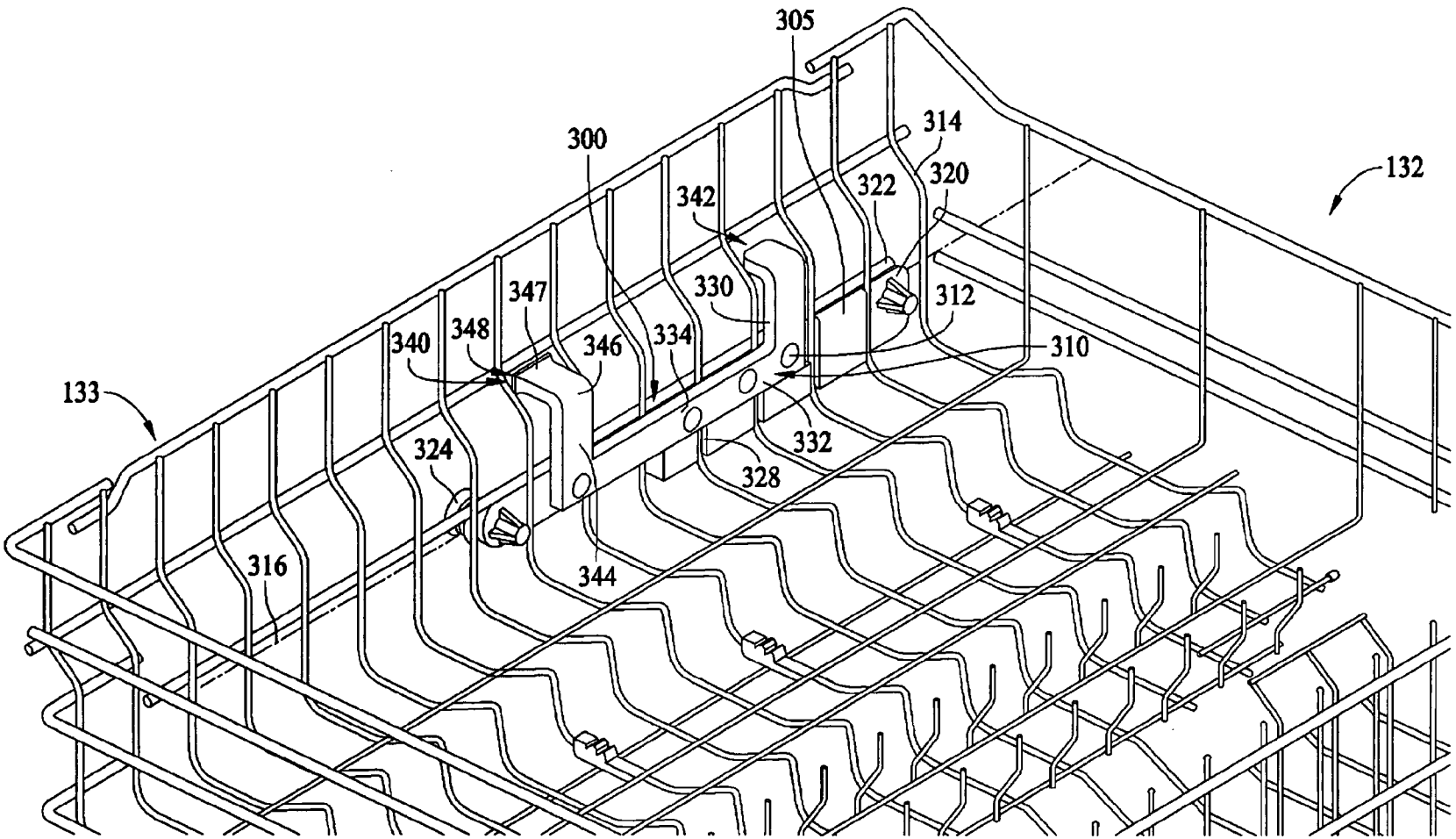
FIG. 2 is a top perspective view of an exemplary embodiment of an adjustable rack assembly

FIG. 2 is a top perspective view of an exemplary embodiment of an adjustable rack assembly 300. Adjustable rack assembly 300 is slideably mounted to at least one lateral side 133 of upper rack 132. Adjustable rack assembly 300 includes a bracket 305 and a support plate 310. Bracket 305 is on one side of at least one lateral side 133 and support plate 310 is on an opposing side of at least one lateral side 133. Bracket and support plate 305 and 310 are coupled together such as at least by one fastener 312 so that at least one vertical wire member 314 extends there between.

Bracket 305 is substantially elongate having a longitudinal axis 316. Bracket 305 includes an inner surface 320 and an outer surface 322. Bracket 305 includes rollers or wheels 324 on outer surface 322 at opposing ends of bracket 305. Wheels 324 are rotatably fixed to bracket 305 and receivable within tracks of washing chamber 106 for sliding upper rack 132 between an extended position and a retracted position.

Bracket 305 includes a plurality of grooves 328 on at least one of inner surface 320 and outer surface 322. In one embodiment, grooves 328 extend substantially along the surface of at least one of inner and outer surfaces 320 and 322. In another embodiment, grooves 328 extend substantially perpendicular to longitudinal axis 316 of bracket 305. In another embodiment, grooves 328 form substantially square shaped channels. In a further embodiment, grooves 328 form channels substantially similar to the circular shape of a vertical wire member 314.

Support plate 310 has an inner surface 330 and an outer surface 332. In one embodiment, inner surface 330 has a plurality of grooves 334 for receiving vertical wire members 314. In another embodiment, grooves 334 of support plate 310 are in a complimentary relationship with grooves 328 of bracket 305 forming channels for frictionally engaging vertical wire members 314.

Support plate 310 includes at least a first lever arm 340 and a second lever arm 342. First and second lever arms 340 and 342 includes an arm portion 344, a bend 346, and a handle portion 347 extending from bend 346. In one embodiment, handle portion 347 is substantially perpendicular to arm portion 344. In an exemplary embodiment, at least one of first and second lever arms 340 and 342 includes a catch member 348 on a distal end thereof. In one embodiment, catch member 348 is molded on support portion 346 of a least one of first and second lever arms 340 and 342.

Figure 4:
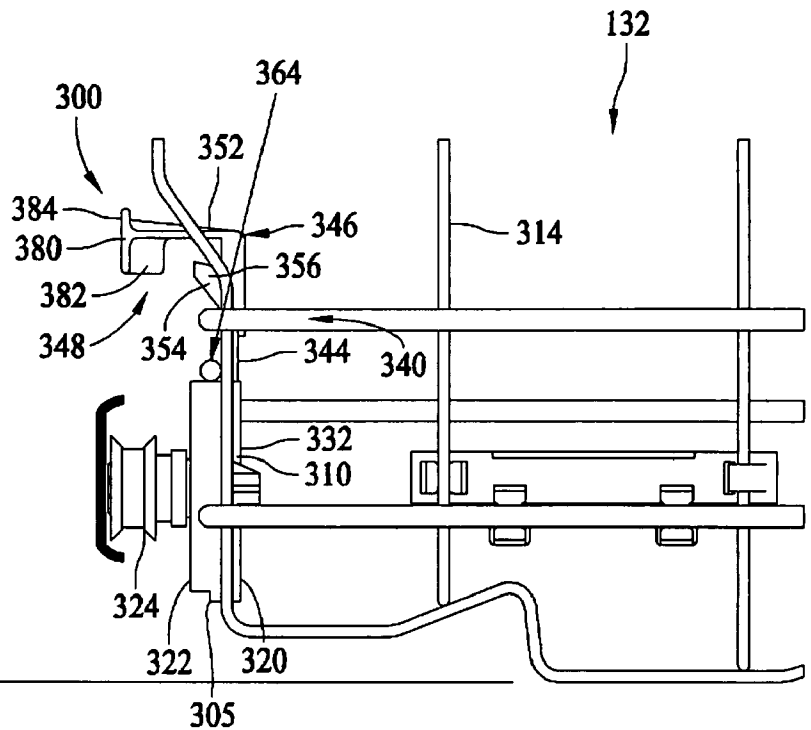
FIG. 4 is a side view of the adjustable rack assembly shown in FIG. 2 with the upper rack in a lowered position.
Figure 3:
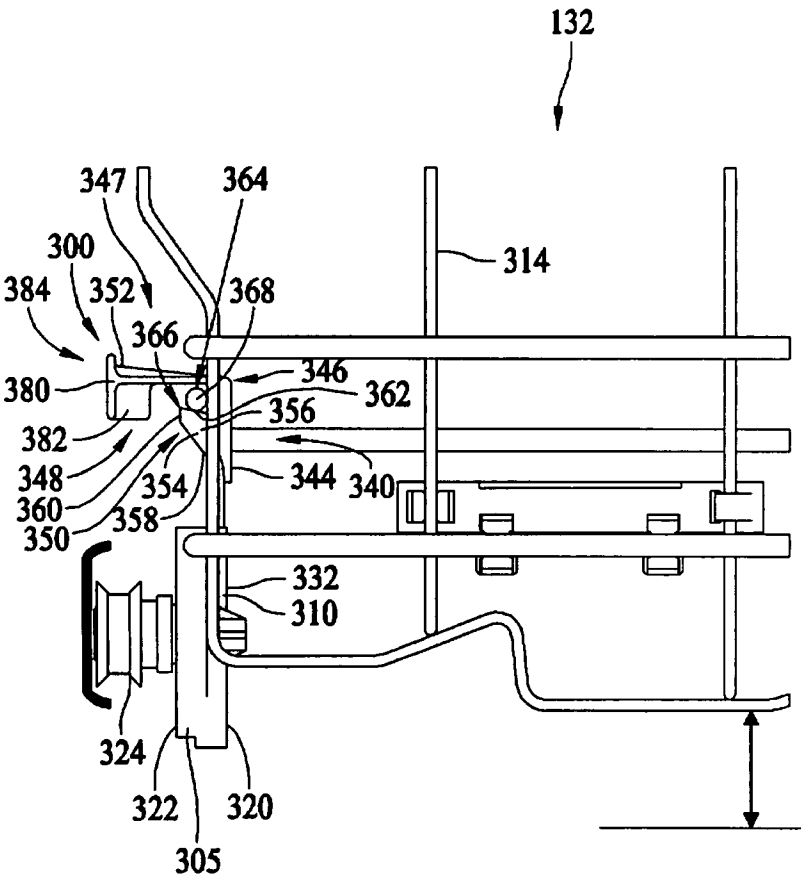
FIG. 3 is a side perspective view of the adjustable rack assembly shown in FIG. 2 with an upper rack in an elevated position.

FIG. 3 is a side perspective view of adjustable rack assembly 300 and upper rack 132 in a elevated position. FIG. 4 is a side view of adjustable rack assembly 300 and upper rack 132 in a lowered position. Catch member 348 includes a ramp portion 350 and a latch portion 352. Ramp portion 350 includes a slide section 354 and a base section 356. Slide section 354 includes an angled sliding surface 358 with respect to vertical wire member 314. Base section 356 includes a substantially vertical sliding surface 360 and a substantially horizontal base support surface 362 for supporting a horizontal wire member 364. In one embodiment, base section 356 includes a lip 366 to retain horizontal wire member 364. In another embodiment, a base support surface 362 is arcuate forming a half pipe or pocket 368 so as to receive at least one horizontal wire member 364. In another embodiment, horizontal wire member 364 is secured into pocket 368 of base support surface 362 by a snapping frictional engagement.

Latch portion 352 of catch member 348 includes a finger portion 380 and a tab portion 382. Finger portion 380 includes a substantially flat surface 384 that is substantially parallel to vertical wire member 314. Tab portion 382 extends from one side of finger portion 380 and is substantially perpendicular to finger portion 380.

Figure 5:
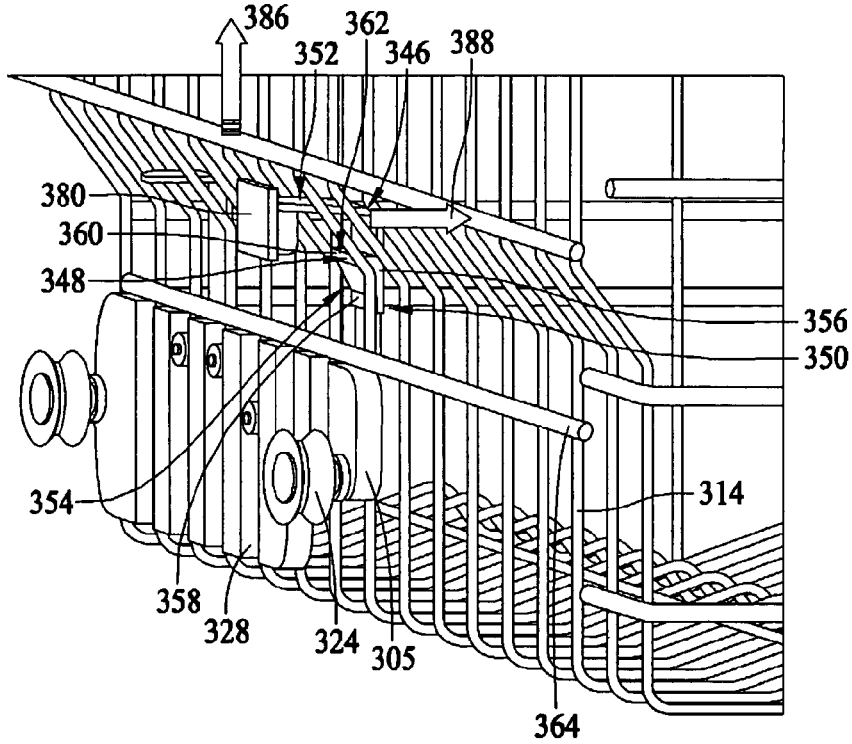
FIG. 5 is a side perspective view of the adjustable rack assembly shown in FIG. 2 with the upper rack in a lowered position.
Figure 6:
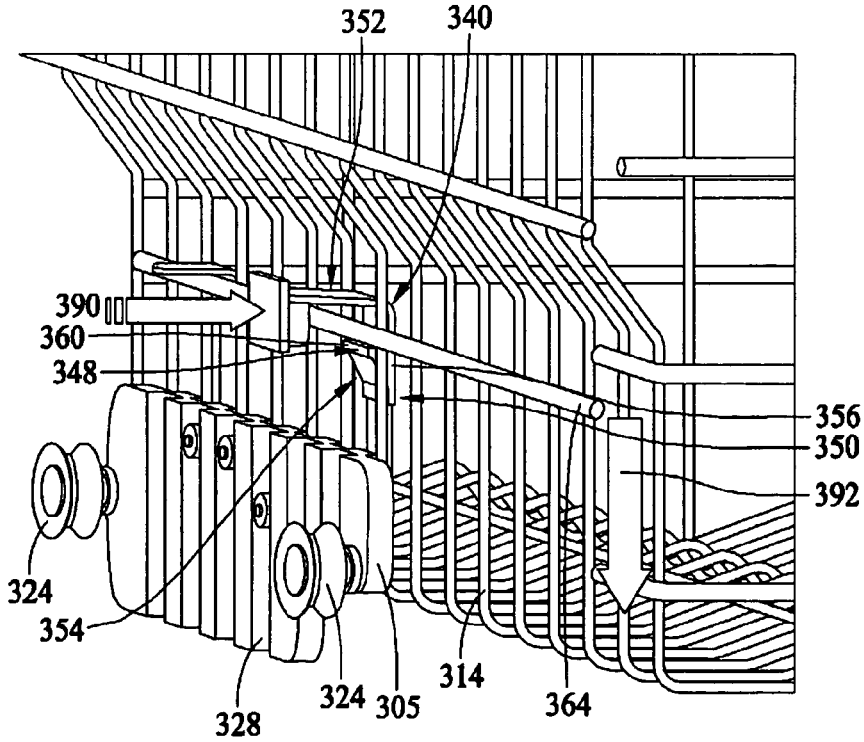
FIG. 6 is a side perspective view of the adjustable rack assembly shown in FIG. 2 with the upper rack in an elevated position.

Adjustable rack assembly 300 adjusts upper rack 132 between a elevated and lowered position as shown in FIGS. 5 and 6. FIG. 5 is a side perspective view of adjustable rack assembly 300 with upper rack 132 in the lowered or first position. In the first position, at least one horizontal wire member 364 is supported on bracket 305. FIG. 6 is a side perspective view of adjustable rack assembly 300 with upper rack 132 in the elevated or second position. In the second position, catch member 348 receives and supports at least one horizontal wire member 364. When adjusting upper rack 132 between first and second positions, vertical wire members 314 slide between bracket 305 and support plate 310 within grooves 328 and 334 of inner surfaces 320 and 322 of bracket 305 and support plate 310.

In use and to adjust rack from the first position to the second position, a user manually lifts upper rack 132 in the direction of an arrow 386. As horizontal wire member 364 contacts ramp portion 350 of catch member 348, first lever arm 340 is deflected away from horizontal wire member 364, as shown by an arrow 388. Horizontal wire member 364 slides along sliding surface 358 and then along vertical sliding surface 360 until horizontal wire member 364 is seated within base support surface 362 and first arm 340 returns to its upright and undeflected position, as shown in FIG. 6.

To adjust upper rack 132 from the second position to the first position, the user applies a force on finger portion 380 of catch member 348 in the direction of an arrow 390. First lever arm 340 has sufficient spring action to provide a minimal resistance force against the user's applied force. Once horizontal wire member 364 has been unseated from base support surface 362, upper rack 132 drops, as shown by an arrow 392, until horizontal wire member 364 is supported by bracket 305 in the first position.

While the invention has been described in terms of various specific embodiments, those skilled in the art will recognize that the invention can be practiced with modification within the spirit and scope of the claims.

What is claimed is:

1. An adjustable rack assembly for a dishwasher in combination with at least one rack, the at least one rack comprising a plurality of sidewalls, each sidewall of the plurality of sidewalls including at least one horizontal wire member and at least one vertical wire member defining an interior side and an exterior side of said at least one rack, said assembly comprising:

a bracket configured to be coupled to the exterior side of a first said sidewall, said bracket including a support surface configured to support and engage the at least one horizontal wire member in a first vertical rack position; and a support plate configured to be coupled to the interior side of the first said sidewall, said support plate coupled to said bracket, said bracket and said support plate having complementary grooves forming closed channels for frictionally engaging the at least one vertical wire member, said support plate having at least one arm with a catch member on a distal end thereof, said catch member being vertically spaced from said support surface of said bracket so that said catch member engages the at least one horizontal wire member in a second vertical rack position and disengages the at least one horizontal wire member in the first vertical rack position.

2. An adjustable rack assembly according to claim 1 wherein said at least one arm is deflectable away from the at least one horizontal wire member when the rack is moved between said first and second positions.

3. An adjustable rack assembly according to claim 1 wherein said bracket has at least one wheel receivable within a track of an appliance.

4. An adjustable rack assembly according to claim 3 wherein said wheel is receivable within a track of a dishwasher.

5. An adjustable rack assembly according to claim 3 wherein said wheel is receivable within a track of a refrigerator.

6. An adjustable rack assembly according to claim 1 wherein said catch member further comprises a ramp portion comprising a slide section and a base section, said base section supports the at least one horizontal wire member when the rack is in said second position.

7. An adjustable rack assembly according to claim 6 wherein said base section comprises a lip to retain the at least one horizontal wire member.

8. An adjustable rack assembly according to claim 6 wherein said base section defines a pocket to receive the at least one horizontal wire member.

9. An adjustable rack assembly according to claim 8 wherein said pocket secures the at least one horizontal wire member in frictional engagement.

10. A dishwasher rack comprising:

a plurality of horizontal and vertical wire members forming a bottom surface and lateral extending sidewalls defining an interior side and an exterior side of said dishwasher rack;

a bracket having an inner surface and an outer surface, said bracket positioned on said exterior side of a first sidewall of said lateral extending sidewalls, said inner surface having grooves, said bracket including a support surface supporting at least one horizontal wire member in a first vertical rack position; and a support plate having an inner surface and an outer surface, said support plate positioned on said interior side of said first sidewall from said bracket, said inner surface having grooves, said support plate coupled to said bracket such that said grooves of said bracket and said support plate form a plurality of closed channels configured to slidably receive said vertical wire members, said support plate having at least one arm with a catch member on a distal end thereof, said catch member being vertically spaced from said support surface of said bracket so that said catch member engages the at least one horizontal wire member in a second vertical rack position and disengages the at least one horizontal wire member in the first vertical rack position.

11. A dishwasher rack according to claim 10 wherein said at least one arm is deflectable away from the at least one horizontal wire member when the dishwasher rack is moved between said first and second positions.

12. A dishwasher rack according to claim 10 wherein said catch member further comprises a ramp portion, said ramp portion having a slide section and a base section, said base section supports the at least one horizontal wire member when the dishwasher rack is in said second position.

13. A dishwasher rack according to claim 12 wherein said base section defines a pocket to receive the at least one horizontal wire member.

14. A dishwasher rack according to claim 12 wherein said catch member further comprises a latch portion extending from said ramp portion.

15. A dishwasher rack according to claim 14 wherein said latch portion has a finger portion.

16. A dishwasher comprising:

a wash chamber defined by a bottom, oppositely disposed sidewalls, a back wall, and a front access opening; and a rack disposed within said wash chamber, said rack having a plurality of vertical and horizontal wire members forming a bottom surface and lateral extending sidewalls defining an interior side and an exterior side of said dishwasher rack, said rack comprising:

a bracket on said exterior side of a first sidewall of said lateral extending sidewalls, said bracket including a support surface supporting and engaging at least one horizontal wire member of said plurality of horizontal wire members in a first vertical rack position; and a support plate on said interior side of said first sidewall, said support plate coupled to said bracket, said bracket and said support plate having complementary grooves forming closed channels for frictionally engaging at least one vertical wire member of said plurality of vertical wire members, said support plate having at least one arm with a catch member on a distal end thereof, said catch member being vertically spaced from said support surface of said bracket so that said catch member engages the at least one horizontal wire member in a second vertical rack position and disengages the at least one horizontal wire member in the first vertical rack position.

17. A dishwasher according to claim 16 wherein said bracket has at least one wheel receivable within a track of a dishwasher.

18. A dishwasher according to claim 16 wherein said catch member comprises a ramp portion, said ramp portion having a slide section and a base section, said base section supports the at least one horizontal wire member when the dishwasher rack is in said second position.

19. A dishwasher according to claim 18 wherein said base section has a lip to retain the at least one horizontal wire member.

20. A dishwasher according to claim 18 wherein said base section defines a pocket to receive the at least one horizontal wire member.

21. A dishwasher according to claim 20 wherein said pocket secures the at least one horizontal wire member in snapping engagement.

* * * * *